US007439927B2

(12) United States Patent
Lenart et al.

(10) Patent No.: US 7,439,927 B2
(45) Date of Patent: Oct. 21, 2008

(54) DIPOLE DESIGN

(75) Inventors: Gregor Lenart, Täby (SE); Jens Malmgren, Cannes-la-Bocca (FR)

(73) Assignee: Cellmax Technologies AB, Täby (SE)

( * ) Notice: Subject to any disclaimer, the term of this patent is extended or adjusted under 35 U.S.C. 154(b) by 95 days.

(21) Appl. No.: 10/599,948

(22) PCT Filed: Apr. 15, 2005

(86) PCT No.: PCT/SE2005/000547

§ 371 (c)(1),
(2), (4) Date: Oct. 13, 2006

(87) PCT Pub. No.: WO2005/101575

PCT Pub. Date: Oct. 27, 2005

(65) Prior Publication Data

US 2007/0200783 A1 Aug. 30, 2007

(30) Foreign Application Priority Data

Apr. 15, 2004 (SE) ..... 0400974

(51) Int. Cl.
*H01Q 21/26* (2006.01)

(52) U.S. Cl. ..... 343/797; 343/793; 343/795; 343/798

(58) Field of Classification Search ..... 343/797, 343/793, 795, 798
See application file for complete search history.

(56) References Cited

U.S. PATENT DOCUMENTS

| | | | | |
|---|---|---|---|---|
| 3,896,450 | A * | 7/1975 | Fitzroy et al. | 343/797 |
| 6,028,563 | A * | 2/2000 | Higgins | 343/797 |
| 6,072,439 | A * | 6/2000 | Ippolito et al. | 343/797 |
| 6,734,829 | B1 * | 5/2004 | Gottl | 343/815 |
| 6,933,906 | B2 * | 8/2005 | Stolle et al. | 343/797 |
| 7,132,995 | B2 * | 11/2006 | Gottl | 343/797 |

* cited by examiner

*Primary Examiner*—Trinh V Dinh
(74) *Attorney, Agent, or Firm*—The Jansson Firm; Pehr Jansson

(57) ABSTRACT

A broadband dipole including two co-working conductors. The invention is characterized in, that a first of the conductors (11) is comprised of a rod (12) including a substantially centrally located axial hole (2), said hole (2) forming an outer conductor (11) of a coaxial line, and that the second conductor (5) is comprised of a solid rod, and that a metallic wire (5) inserted centrally in the axial hole (2) of the first conductor (11) is connected to the second conductor (5).

11 Claims, 5 Drawing Sheets

Figure 1, principle drawing
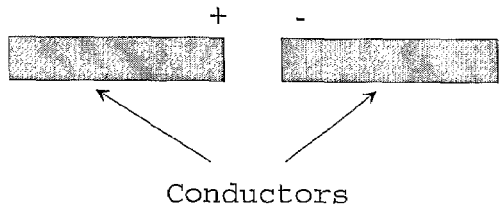
Figure 2
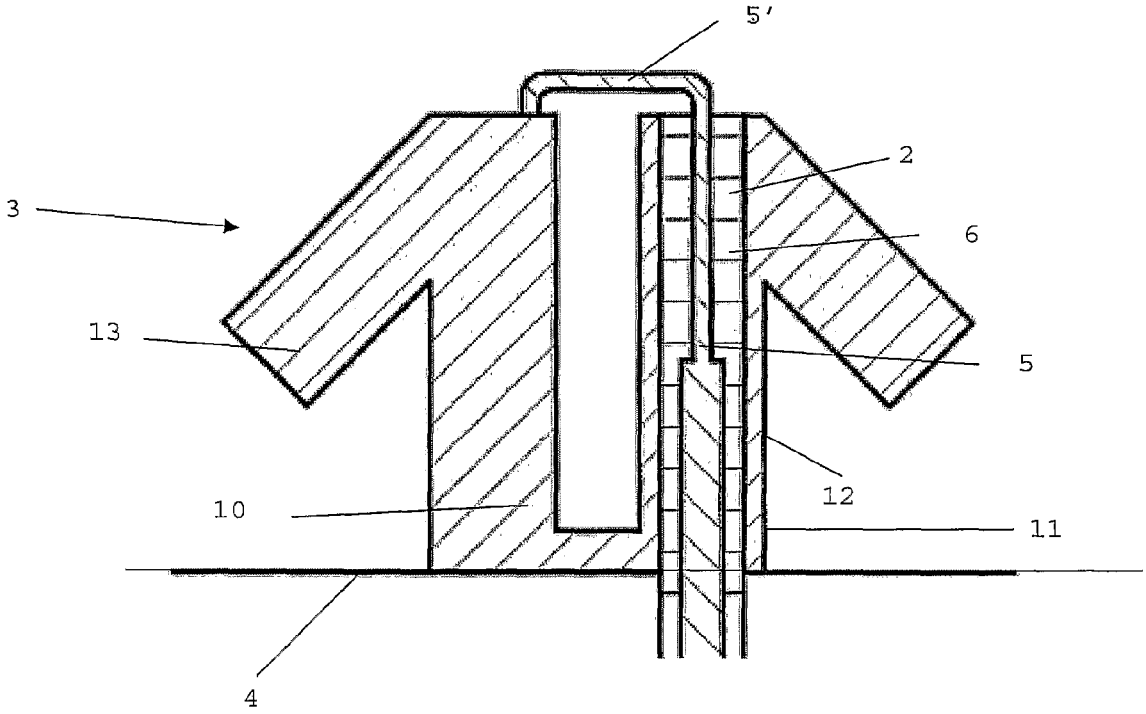

One port made of two similar feeds

Another port made of two similar feeds

One port made of two different feeds

Another port made of two different feeds

DIPOLE DESIGN

BACKGROUND OF THE INVENTION

1. Field of the Invention

Present invention refers to antennas for radio communications with broad bandwidth.

2. Description of the Related Art

Antennas for radio communication consist of one or more radiating elements. In case of multiple elements, these are connected in a specifically designed array in order to get the required radiation pattern.

The radiating element can be of different types, e.g. a monopole, a dipole, a patch etc. Each of these types has different advantages and drawbacks.

Dipoles are suitable to use in low loss antennas. The half-wave dipole is a straight conductor that is one half wavelength long, generally fed in the middle. In practice, most dipoles are built with two straight conductors that are a quarter wavelength long. In order to feed this design properly, the signals applied on each of the two wires must have the same amplitude and be in counter-phase described as + and –, see FIG. 1. This type of feeding is called Balanced.

For a sector antenna a ground plane is generally placed behind the dipole at a distance of approximately a quarter wavelength. This enhances the antenna directivity by reducing its radiation towards the back.

Generally, transmission lines deliver an unbalanced signal. To transform this signal into a balanced one, one solution is to use a Balun transformer, abbreviated balanced-unbalanced.

Today it is often required to cover more than one cellular and UMTS of 1920-2170 MHz. For this purpose, it is desirable to use dipoles covering the complete bandwidth of 1710-2170 MHz. For such a dipole to be usable, it needs to provide a stable radiation pattern as well as being impedance matched over the whole bandwidth.

The problem with state-of-the-art dipoles is that they do not combine wide bandwidth with low loss. In some cases, complex matching networks are used to improve the broadband impedance matching of the dipoles.

SUMMARY OF THE INVENTION

Present invention relates to a broadband dipole including two co-working conductors, and is characterised in, that a first conductor is comprised of a rod including a substantially centrally located axial hole, the walls of said hole forming an outer conductor of a coaxial line, and that the second conductor is comprised of a solid rod, and that a metallic wire inserted centrally in the axial hole of the first conductor is connected to the second conductor.

In the following the present invention is described in more detail, partly in connection with an embodiment of the invention together with the attached drawings, where

BRIEF DESCRIPTION OF THE DRAWINGS

FIG. 1 schematically shows a principal drawing of a dipole.

FIG. 2 shows a cross-section of a dipole of present invention.

DETAILED DESCRIPTION OF THE INVENTION

Figure 3:
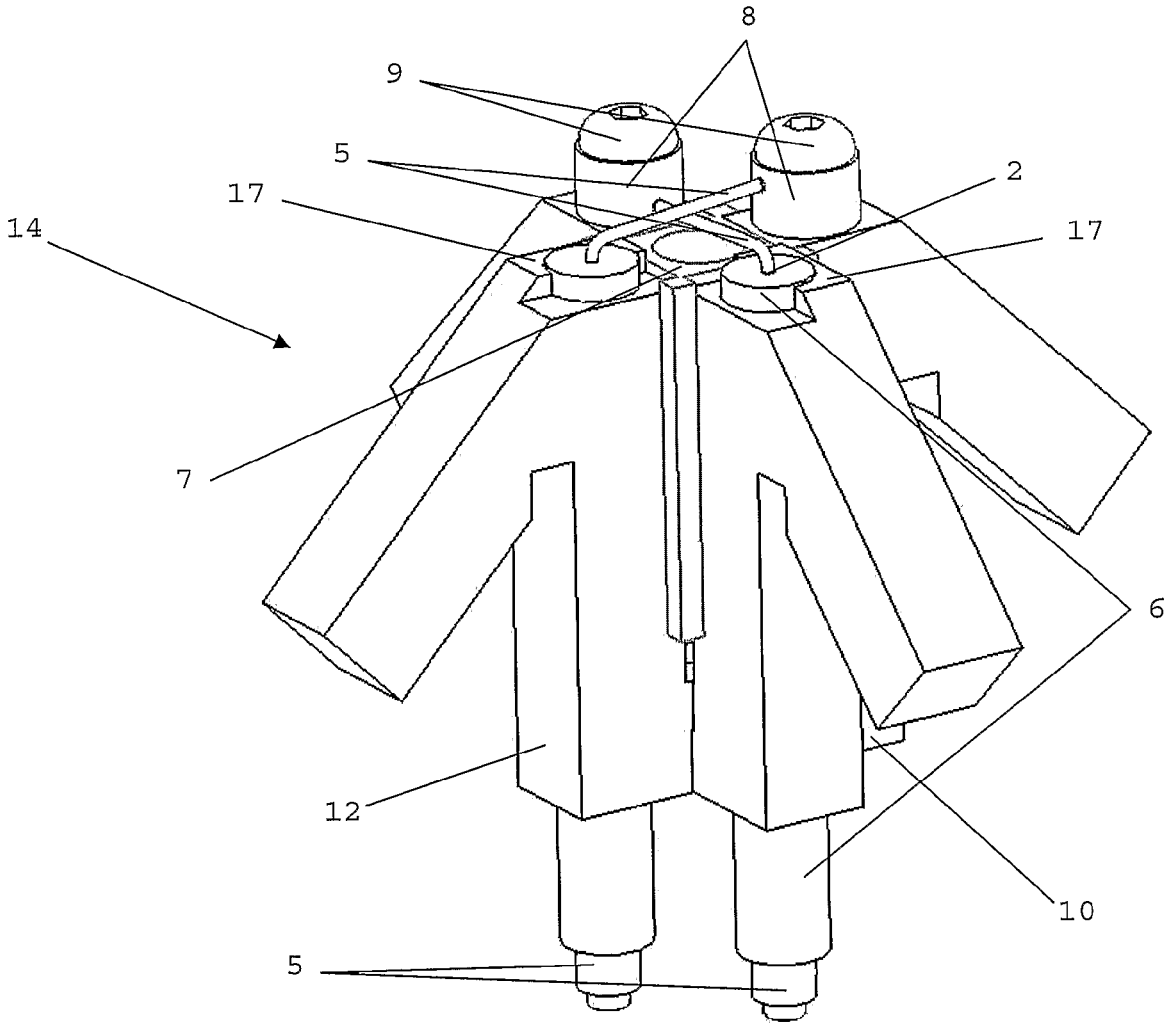
FIG. 3 shows schematically two superimposed dipoles including a dielectric rod in the middle of the dipoles.

Present invention thus relates to a broadband dipole including two co-working conductors.

FIG. 2 shows this innovative dipole 3 that also includes the Balun, described above. Two vertical rods 10, 12 are approximately a quarter wavelength long, and form the Balun. The left vertical rod 10 is solid, whereas the right vertical rod 12 is provided with a hole 2 in it. Said hole 2 of the rod 12 is used as an outer conductor 11 of a coaxial line. A second conductor 5, e.g. a metallic wire, is comprised of a solid rod inserted centrally in the axial hole 2 of the outer conductor 11. There is a dielectric material 6 placed between the two conductors 5, 11. The metallic wire 5 is bent 5' from the right vertical rod 12, over to the solid left vertical rod 10, and connected to the top of the left vertical rod 10. The outer conductor 11 is connected to the right half of the dipole 3, and the inner conductor 5 is as explained above connected to the left half of the dipole. Hence the two halves of the dipole 3 are fed in counter-phase. There are included integrated folded back parts 13 of both left and right rods 10, 12 towards a ground plane 4.

Furthermore, FIG. 2 shows the inner conductor 5, i.e. the metallic wire, the dielectric material 6 and an attachment. The metallic wire 5 is not a simple transmission line but also acts as an impedance transformer that allows matching of the dipole 3 over a broad bandwidth. The above said impedance transformer is made of different dimensions and is surrounded by the dielectric material 6. The dielectric material 6 is inserted between the metallic wire 5 and the wall of the hole 2 forming the outer connector 11. The dielectric material 6 is preferably made of a polymer, for example Teflon.

FIG. 3 shows a superimposed dipole 14, where two dipoles 3 are superimposed. The advantage of this solution is that the antenna radiates in two orthogonal polarizations. The back folded parts 13 provide its radiation pattern more wideband. Still the problem with broadband matching remains. In order to obtain a wideband matching it is desirable to match as near the dipole 3 or the superimposed dipole 14 as possible.

Because of this double dipole configuration, i.e. the superimposed dipole 14, the two rods 10, 12 forming the Balun cannot be as close to each other as they should in order to get a proper Balun performance. Therefore, a dielectric rod 7 is inserted in the middle of the superimposed dipole 14. The dielectric rod 7 brings the two rods 10, 12 electrically closer to each other.

With a cross-polarised antenna, it is important to keep the coupling between the two polarisations low. In order to adapt the basic single dipole for cross-polarisation, the two halves of the dipoles must be placed very close to each other. This leads to more coupling between the two polarisations than acceptable. By introducing a small asymmetric coupling between the two tops of the dipole, the basic coupling between the two polarisations can be reduced to acceptable levels. The asymmetric coupling is realised by increasing the height of half 17 of the dipole top on one side of the antenna, as can be seen in FIG. 3.

Figure 4:
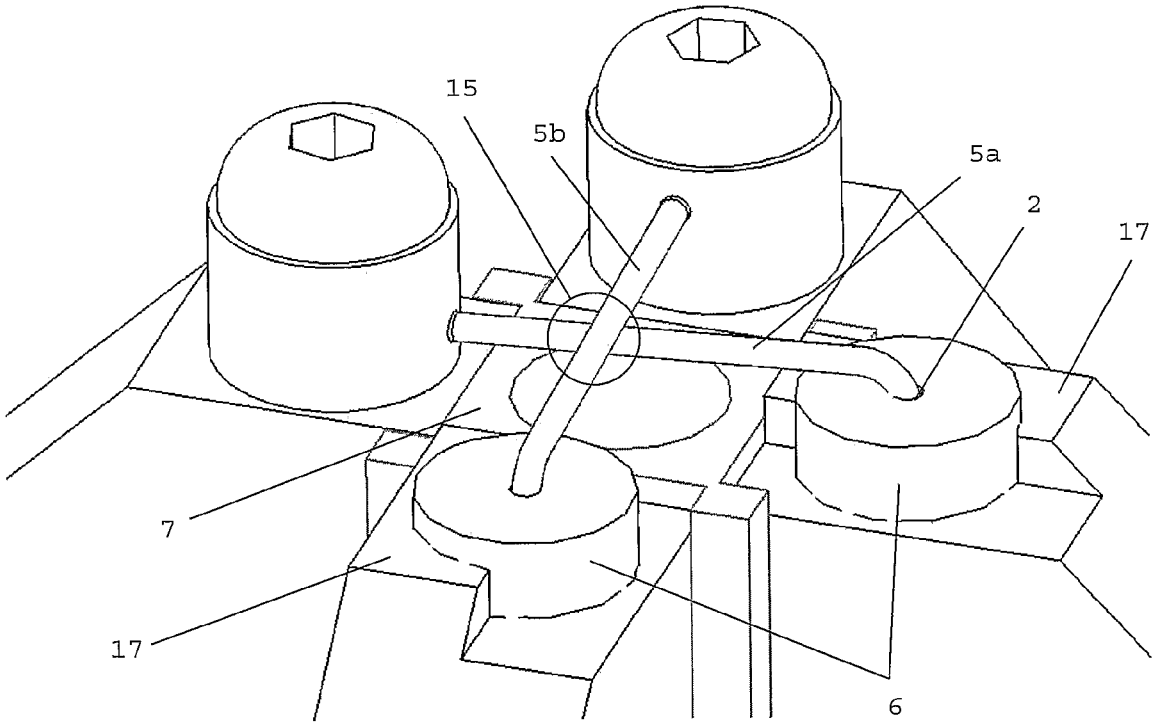
FIG. 4 shows schematically the feed crossing of a dipole.

FIG. 4 shows the superimposed dipole 14 arrangement. The inner conductors 5*a* and 5*b* from different dipoles 3 cannot be in contact because they would short-circuit each other. One solution is to make a feed crossing 15 where one inner conductor 5*a* is bent and placed under the other inner conductor With such an arrangement, the characteristic of the two dipoles 3 forming the superimposed dipole pair 14 gets slightly asymmetrical, see FIG. 5*a*.

Figure 5A:
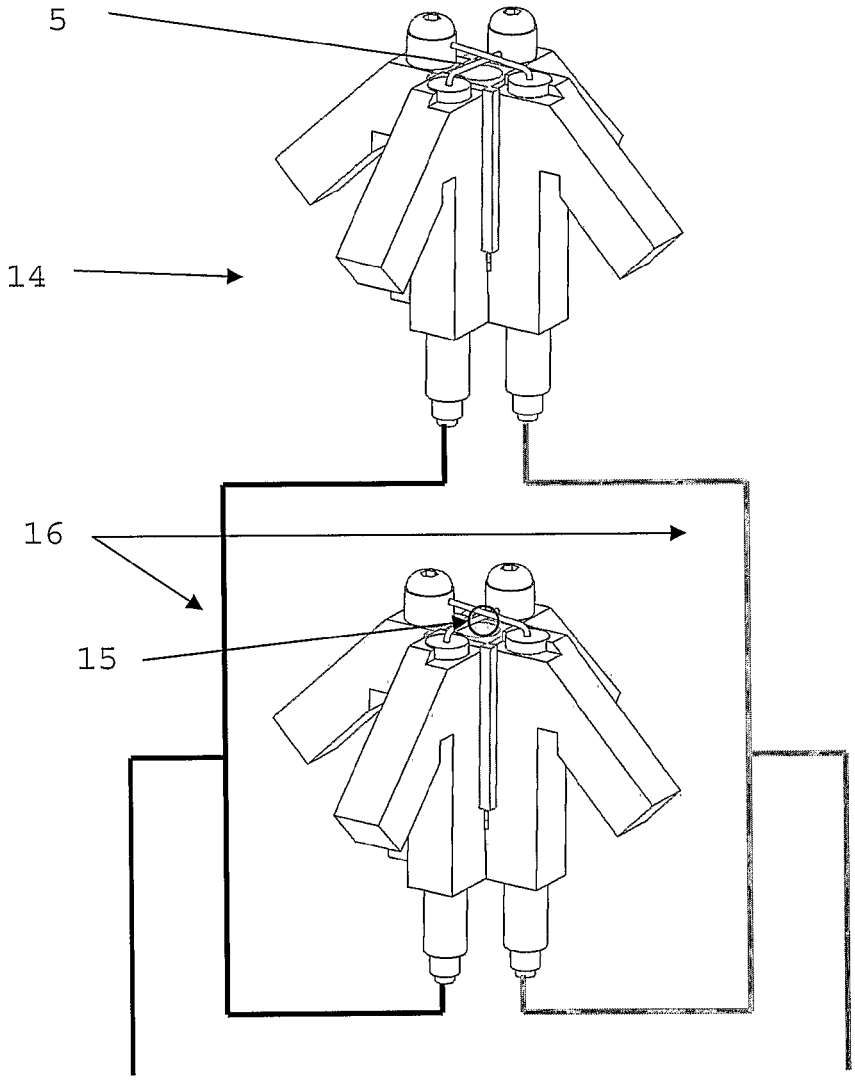
FIG. 5*a* shows schematically how two similar feeds connect to each other.

In one embodiment, see FIG. 5*a*, the superimposed dipoles 14 are usually used in a dipole array 16 in order to increase the antenna gain. In a single row dipole array 16, dipole feed crossings 15 of same type are connected together, i.e. inner conductors 5 that are bent under or above the other inner conductors 5. In FIG. 5*a* it forms that all dipoles that have their coaxial line coming out on the left side are connected together, and those coming out on the right side are connected together. With all dipoles being asymmetrical, this asymmetry adds up, and neither impedance matching nor antenna radiation will be the same for both polarizations.

Figure 5B:
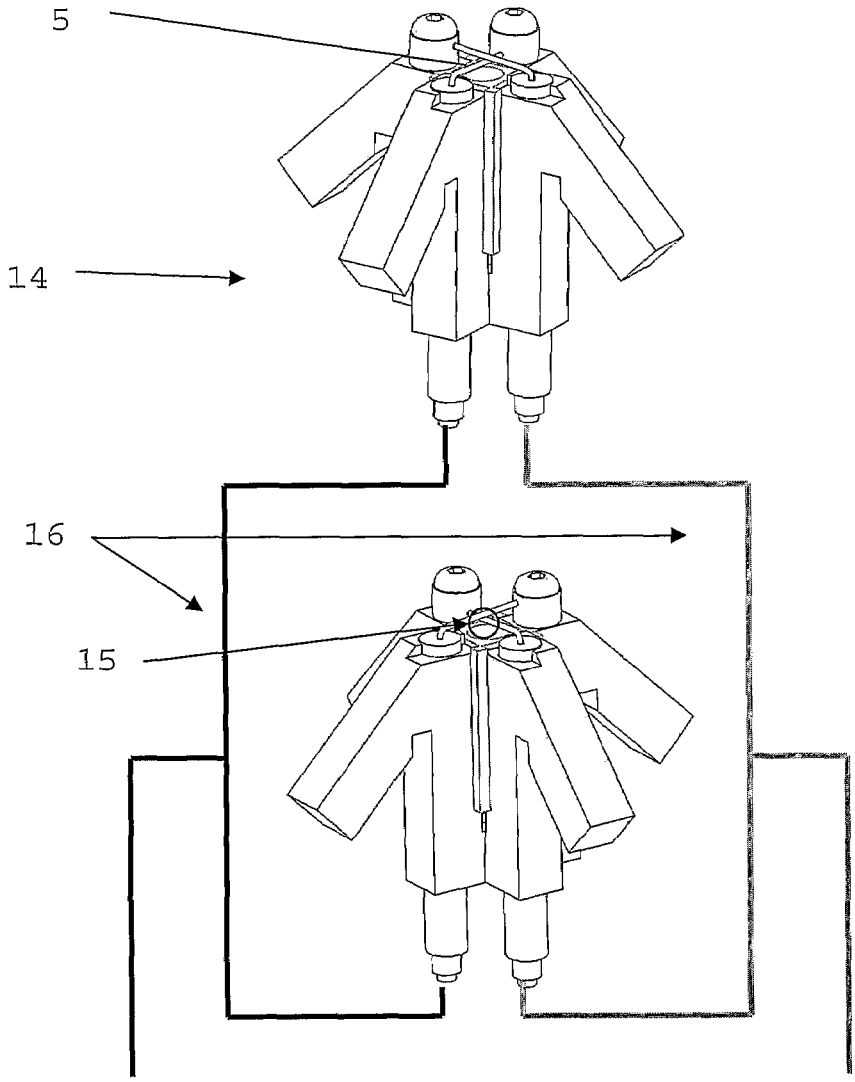
FIG. 5*b* shows schematically how two different feeds alter-

Another embodiment is a solution to the asymmetrical dipoles, see FIG. 5*b*. In this embodiment alternated dipole feed crossings are connected together. Thereby the feed crossings are alternated along the dipole array 16 and the asymmetrical dipoles' 3 non impedance matching is erased.

Above, several embodiments of broadband dipole have been described. However, present invention can be used in any configuration of broadband dipoles where the larger bandwidth and impedance matching can be compensated for by a dipole according to the invention.

Thus, the present invention shall not be deemed restricted to any specific embodiment, but can be varied within the scope of the claims.

The invention claimed is:

1. A broadband dipole comprising:

two superimposed dipoles (3) each including co-working conductors, wherein a first of the conductors (12) of each dipole is comprised of a rod (12) including a substantially centrally located axial hole (2), the walls (11) of said hole (2) forming an outer conductor of a coaxial line, and a metallic wire (5) inserted centrally in the axial hole (2) thereby forming an inner conductor of said coaxial line; and a second conductor (10) of each dipole is comprised of a solid rod connected to the metallic wire (5')

wherein the two dipoles are superimposed to form a middle between the first and second conductors of both dipoles; and a dielectric rod (7) inserted in the middle formed by superimposing the two dipoles.

2. The broadband dipole according to claim 1, wherein a dielectric material (6) is inserted between the metallic wire (5) and the wall of the hole (2) in the first conductor (12).

3. The broadband dipole according to claim 1 or 2, wherein each of the conductors (10,12) includes an integrated folded back part (13) of the rod.

4. The broadband dipole according to claim 3, wherein coupling between two dipoles (3) is minimized by increasing the height of half (17) of the dipole (14) top.

5. The broadband dipole according to claim 4, wherein dipole feed crossings (15) of the same type are connected together.

6. The broadband dipole according to 4, wherein alternated dipole feed crossings (15) are connected together.

7. The broadband dipole according to claim 3, wherein alternated dipole feed crossings (15) are connected together.

8. The broadband dipole according to claim 1 or 2, wherein coupling between two dipoles (3) is minimized by increasing the height of half (17) of the dipole (14) top.

9. The broadband dipole according to claim 8, wherein alternated dipole feed crossings (15) are connected together.

10. The broadband dipole according to claim 1 or 2, wherein alternated dipole feed crossings (15) are connected together.

11. A broadband dipole comprising:

a first and a second dipole (3) superimposed one upon the other, each having:

a solid rod and a hollow rod with an internal axial hole, the walls of said hole forming an outer conductor of a coaxial line;

an inner conductor located centrally in the internal axial hole and connected to the solid rod; and a dielectric rod (7) located between the solid rod and the hollow rod of the first dipole and between the solid rod and the hollow rod of the second dipole.

* * * * *